US005187317A

United States Patent [19]

Pellarin et al.

[11] Patent Number: 5,187,317

[45] Date of Patent: Feb. 16, 1993

[54] FIRE CONTROL SYSTEM HAVING LASER TELEMETRY ADAPTABLE FOR A MANTLET SIGHT

[75] Inventors: Jean-François R. Pellarin, Saint-Cyr l'Ecole; Michel Peion, Plaisir, both of France

[73] Assignee: Giat Industries, France

[21] Appl. No.: 603,598

[22] Filed: Oct. 26, 1990

[30] Foreign Application Priority Data

Oct. 27, 1989 [FR] France ..... 89 14113

[51] Int. Cl.[5] ..... F41G 3/22

[52] U.S. Cl. ..... 89/36.14; 89/41.06; 89/41.09

[58] Field of Search ..... 89/36.14, 37.12, 41.06, 89/41.09

[56] References Cited

U.S. PATENT DOCUMENTS 2,360,850 10/1944 Colby ..... 89/36.14

4,885,977 12/1989 Kirson et al. ..... 89/41.09

OTHER PUBLICATIONS

Scidmore, Wright H., "Optical Design of Day/Night Periscopes for Combat Vehicles", Army Research and Development News, Sep.-Oct., 1974, pp. 20-21.

*Primary Examiner*—Stephen C. Bentley

*Attorney, Agent, or Firm*—Parkhurst, Wendel & Rossi

[57] ABSTRACT

This invention concerns a fire control system which is adaptable on a mantlet sight of a combat vehicle, and, in particular, is of the type that comprises a stabilized mirror 10, a rangefinder laser 13 and an electronic control unit.

The fire control system of the present invention includes a casing welded onto the turret mantlet, which contains a stabilized mirror inclined with respect to the horizontal line so as to correlate the stabilized aiming axis through the mirror to the gun trunnion axis and the firing axis, a laser being arranged so as to send and receive beams along the sight aiming axis of the mantlet sight and of the stabilized sight. Optical means are located between the stabilized mirror and the sight and are made up of a semi-transparent plate, a dichroic plate and a mirror to ensure the harmonization of the laser transmission and reception beams with respect to the aiming axis of the sight.

The dichroic plate is fixed and inclined at 45° with respect to the aiming axis of the sight, and the mirror is located in a plane closely perpendicular to that of the dichroic plate, the plate and the mirror being capable reflecting the laser transmission and reception beams.

8 Claims, 2 Drawing Sheets

FIRE CONTROL SYSTEM HAVING LASER TELEMETRY ADAPTABLE FOR A MANTLET SIGHT

FIELD OF THE INVENTION

The technical field of this invention is that of fire control systems for combat vehicles, such as armored vehicles, tanks, etc.

The main function of combat vehicles is to destroy or neutralize an enemy. The conditions in which this function is carried out are increasingly constraining with respect to equipment. Today, an army requires equipment for use at any time of day and night under difficult climatic conditions: rain, snow and fog. Similarly, increased performance has lead to a reduction in response time against a potential enemy by providing combat vehicle with means to fire while on-the-move against mobile targets; the outcome being a multiplication of the firing parameters that have to be taken into account.

The firing function directly associates two sub-functions:

the aiming function, the firing function (weapons + rounds).

The sub-assemblies which fulfill the firing function and which directly contribute to its performance are commonly called fire control systems.

Most of the current combat vehicles are deprived of a fire control system enabling on-the-move firing, sometimes even against mobile targets when the combat vehicle is at standstill, with a high hit probability. The aiming systems can be classified in two families:

mask or mantlet sights which are part of the weapon, roof sights electrically or mechanically slaved to the weapon.

The first class of sights equips most combat tanks. They exist in several versions.

The old systems consist of a gunner mantlet sight (slaved to the gun) whose "fire control system" is limited to an engrave micrometer indicating the ballistic corrections corresponding to the type of round and the firing distance.

The most recent systems offer, along with the mantlet sight, a fire control system which enables the crew of the vehicle to carry out standstill firing against mobile targets with a good hit probability.

There exist monoblock sights which fulfill the above functions and which are integrated within a weapon system at the design phase. Most of these sights are roof sights whose implementation on old vehicles requires important modifications which affect the coherence operation of the basic system.

Lastly, development of phase aiming and fire control systems will enable crews to destroy stationary and mobile targets whether their tank is at a standstill or on-the-move.

Nowadays, a great number of tanks lack modern fire control systems, especially laser rangefinding (for automatic calculation of tank to target distance), and moreover, lack sight stabilization which allows for on-the-move observation and firing.

SUMMARY OF THE INVENTION

The objective of this invention is therefore to propose a fire control system to equip combat vehicles with a mantlet sight which would ensure line of sight stabilization and laser rangefinding.

Consequently, this invention aims at adapting a fire control system to a combat vehicle mantlet sight, and is of the type that comprises a stabilized mirror, a laser rangefinder and an electronic control unit. It is also characterized by the fact that it comprises a casing which is welded to the turret mantlet. This casing contains a stabilized mirror inclined with respect to the horizontal plane so as to correlate the aiming axis, passing through the mirror, to the weapon trunnion axis and the the firing axis, the laser being set up to send its transmission and reception beams along the sight aiming axis and the stabilized sight axis.

The fire control system includes an optical block, installed between the stabilized mirror and the sight, made up of a semi-transparent plate, a dichroic plate and a mirror to ensure harmonization between laser transmission and reception beams and sight aiming axis.

The dichroic plate is fixed and inclined at 45° with respect to the sight aiming axis, and the mirror is located in a plane closely perpendicular to that of the dichroic plate, the plate and the mirror being capable of reflecting the laser transmission and reception beams.

The mirror is mobile is elevation and azimuth in order to compensate for harmonization deviations between the laser transmission and reception axes and the sight aiming axis.

The laser is provided with a reticle injected along the sight reception path by means of the dichroic plate and the corner of cube presenting its transparent base at 45° with respect to the dichroic plate and placed on the optical path to receive the beam coming from the dichroic plate, which is on one side transparent in the visible region, and on the other side reflective in order to bring the image of the reticle along the sight aiming axis.

The dichroic plate is treated on one side to reflect the laser wavelength and to transmit the visible path, and, on the other side, to partially reflect the visible radiation.

The casing is in the form of a mount into which support slides are inserted.

The laser is mechanically linked to the casing according to a mechanical reference line defined in relation to the weapon trunnion axis and the aiming axis.

One of the advantages of this invention lies in the fact that, for the first time, it is possible to ensure observation and on-the-move firing with a mantlet sight without it being mechanically or optically modified.

Another advantage of this invention device is that its adaptation on a mantlet sight only involves a modification of the landscape path entering the sight, whilst still allowing for aiming and firing functions by means of the sight.

A further advantage of this invention device is that it is in the form of a kit which can be adapted to any type of mantlet sight, thereby reducing cost.

Other advantages of this invention device will become apparent when the additional description given in relation to the following figures is read:

Figure 1:
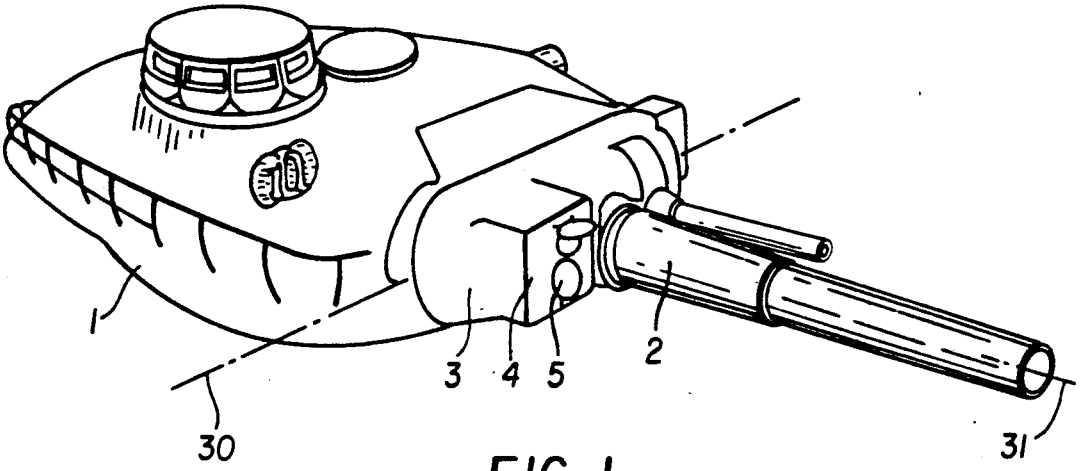
FIG. 1 is a perspective view showing the layout of the fire control system according to the invention.

FIG. 1 shows turret 1 of a combat vehicle equipped in particular with a gun 2, bearing a turret mantlet 3. The turret includes a sight, not represented on this drawing, whose aiming axis axis is parallel to the firing axis 31, i.e., the axis of gun 2. The present invention is integrated in a casing 4 welded on mantlet with recopy of axis 30 of the gun pivots and of the firing axis 3. The harmonization of the aiming and firing axes will be explained in more detail with FIG. 2. The casing is provided, on its front face, with shutters 5 making it possible to block one of the sight paths.

Figure 2:
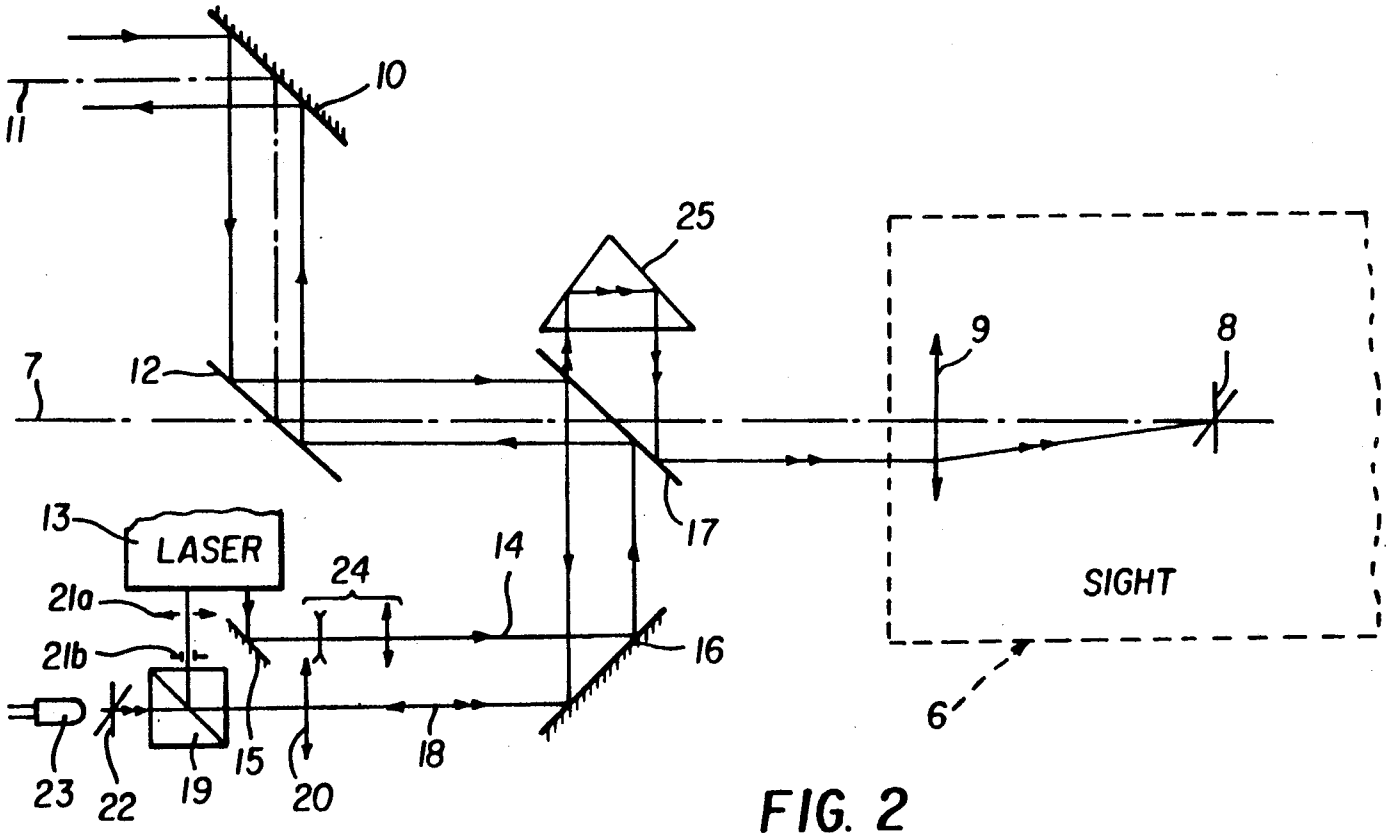
FIG. 2 represents the optical diagram of the fire control system according to the invention.

FIG. 2 is a diagram illustrating the optical structure of the fire control system according to the invention and, in part, that of the mantlet sight 6 having aiming axis 7, aiming reticle 8 and focusing lens 9. The invention device includes a stabilized mirror 10 adjustable in elevation and azimuth which limits the stabilized aiming axis 11 on the sight aiming axis 7, and transmits the aiming axis 7 towards the target. Plate 12 is of the semi-reflective type. A laser path to measure the target distance is integrated in the stabilized aiming axis. Obtained value is entered into a computer, not shown on the figure.

The laser path includes a laser 13, whose transmission path 14 is directed onto the target by a first mirror 15, a second mirror 16, a dichroic plate 17, a plate 12 and the stabilized mirror 10. Each of these optical elements causes a 90° reflection of the light beam; elements are treated to reflect a laser beam of 1,060 Nm wavelength. Mirror 16 is assembled mobile in order to ensure adjustment in elevation and azimuth.

Laser transmission path 14 also comprises a transmission afocal device 24 to limit the divergence of the beam, it is made up of a divergent lens followed by a convergent lens.

The reception path 18 arrives at laser 13 via stabilized mirror 10, plate 12, dichroic plate 17, second mirror 16 and dichroic cube 19. Between cube 19 and second mirror 16, there is a convergent reception and collimation lens 20 whose purpose is to collect a laser return beam and to collimate the laser reticle ad infinitum. Between laser 13 and cube 19, there is a convergent lens **21*a* and a beam diaphragm 21*b* to limit the laser field of reception. Mirror 10, plate 12, dichroic plate 17, mirror 16 and cube 19** ensure the reception path 90° reflections.

The integration of a laser rangefinding requires harmonization of a harmonization reticle with the aiming reticle 8 of sight 6. For this purpose and according to the invention, a reticle 22, known as laser reticle, is engraved, and projected via diode 23 in the laser reception path 18. This reticle 22 is backlit and follows the reception path 18 by crossing dichroic plate 17. The beam is then taken up by a corner of cube 25, and after double reflection, exits parallel to incident beam.

It is then reflected by the dichroic plate 17 towards lens 9 and, in case of concordance, is focused on reticle 8 of sight 6. If there is no concordance, mirror 16 is controlled in elevation and azimuth to bring reticle image of laser 22 on image of reticle 8.

Of course, rangefinding data are sent through an electric link to an electronic control unit of a known type (not represented) located inside the combat vehicle.

Figure 3:
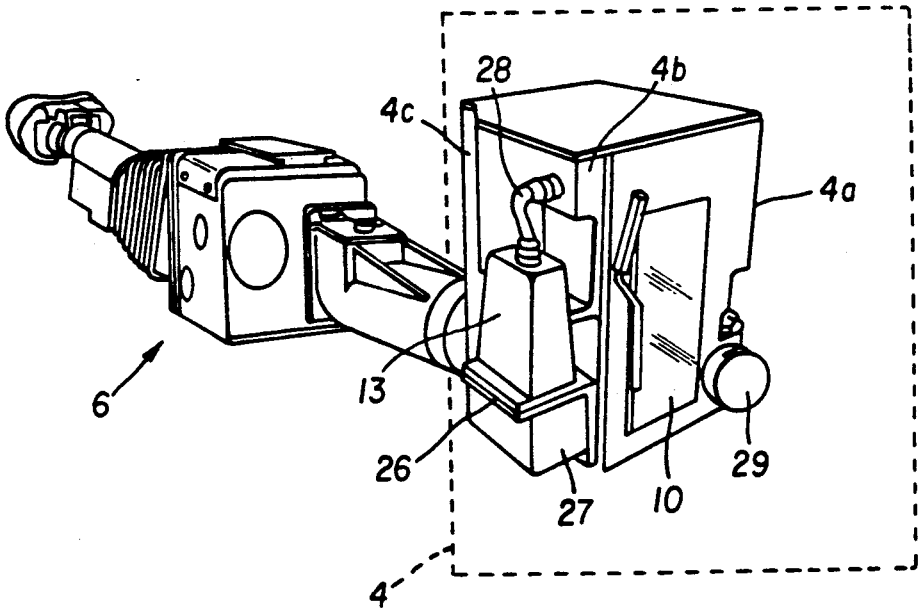
FIG. 3 shows the mechanical structure of the fire control system.

FIG. 3 represents the mechanical structure integrating the invention device assembled in the casing. The optical elements described in relation to FIG. 2 are fixed in a traditional way according to the described layout. However, laser 13 is fixed on a plate 26 which also bears a casing 27 which contains the laser transmission and reception optical elements (15, 24, **21*a*, 21*b*, 19, 20). Plate 26 and casing 27 are part of the internal structure of the casing including slides 4*a*, 4*b* and 4*c*. These slides are engaged inside the casing, according to the mechanical references of the casing. The front slide 4*a* of the casing leaves the stabilized mirror 10 exposed. Laser 13 is supplied via the electric cable 28, which is connected to the electric power supply of the combat vehicle. The electric link exits at level of turret mantlet 3 to enter casing 4. In front of casing 4, one can see mirror adjustment knob 29 serving to harmonize the laser paths with the sight aiming reticle 8. The harmonization procedure of firing axis 31 and aiming axis 7** has already been discussed and needs no further explanation.

The stabilization block is composed of a laying gyroscope equipped mirror mobile according to two axes.

As it appears from description given above, the sight offers two paths:

the stabilized aiming axis (normal path) 11 for on-the-move or standstill observation and firing, stabilized path rangefinder being used to calculate target distance, the standby path 7 which corresponds to the normal aiming axis of sight 6, serves to compensate for any failure of the normal path. It allows observation and firing at standstill only.

To ensure the safety of the observer against laser returns and external rangefinding waves, a protection filter can be fixed on the optical path in front of the sight 6.

We claim:

1. A fire control system adaptable for a pre-existing mantlet sight on a combat vehicle, comprising:

a stabilized mirror which defines a stabilized aiming axis, said stabilized aiming axis being correlated with a firing axis and a weapon trunnion axis of a gun of said combat vehicle;

a laser arranged to send its transmission and reception beams along said stabilized aiming axis via optical means; and a casing welded onto said mantlet sight containing said stabilized mirror, optical means and laser.

2. The fire control system of claim 1, wherein said optical means comprise a semi-transparent plate, a dichroic plate and a mirror for correlation of said transmission and reception beams with a sight aiming axis.

3. The fire control system of claim 2, wherein said dichroic plate is fixed in a 45° position with respect to said sight aiming axis, and said mirror is disposed in a plane substantially perpendicular to that of the dichroic plate, said dichroic plate and said mirror capable of reflecting said transmission and reception beams.

4. The fire control system of claim 3, wherein said stabilized mirror is movable in elevation and azimuth to adjust and properly correlate said stabilized aiming axis with said sight aiming axis.

5. The fire control system of claim 3, further comprising a laser reticle disposed in the path of said reception beam, an image of said laser reticle being transmitted via said dichroic plate and a cube having a transparent base disposed 45° with respect to said dichroic plate and placed to receive a beam coming from said dichroic plate, wherein said dichroic plate has a surface transparent to visible light, and the opposite surface reflective to visible light, thereby projecting said image of said laser reticle along said aiming axis.

6. The fire control system of claim 5, wherein said dichroic plate is treated to reflect the wavelength emitted from said laser and to transmit visible light on one surface, and to partially reflect visible light on the opposite surface.

7. The fire control system of claim 1, wherein said casing is in the form of a mount into which support slides are inserted.

8. The fire control system of claim 7, wherein said laser is mechanically connected to said casing in a position defined by said weapon trunnion axis and said firing axis.

* * * * *